US009046278B2

(12) United States Patent
Köller

(10) Patent No.: US 9,046,278 B2
(45) Date of Patent: Jun. 2, 2015

(54) SMOKE-FREE CIGARETTE

(75) Inventor: Marcel Köller, Adligenswil (CH)

(73) Assignee: Olig AG, Adligenswil (CH)

( * ) Notice: Subject to any disclaimer, the term of this patent is extended or adjusted under 35 U.S.C. 154(b) by 1074 days.

(21) Appl. No.: 12/864,390

(22) PCT Filed: Jun. 29, 2009

(86) PCT No.: PCT/EP2009/004686

§ 371 (c)(1),
(2), (4) Date: Oct. 13, 2010

(87) PCT Pub. No.: WO2009/156181

PCT Pub. Date: Dec. 30, 2009

(65) Prior Publication Data

US 2011/0290266 A1 Dec. 1, 2011

(30) Foreign Application Priority Data

| | | |
|---|---|---|
| Jun. 27, 2008 | (DE) | 10 2008 030 548 |
| Nov. 28, 2008 | (EP) | 08020736 |
| Mar. 12, 2009 | (EP) | 09003622 |
| Mar. 12, 2009 | (EP) | 09003623 |

(51) Int. Cl.
*A24F 47/00* (2006.01)
*F24J 1/00* (2006.01)

(52) U.S. Cl.
CPC . *F24J 1/00* (2013.01); *A24F 47/006* (2013.01)

(58) Field of Classification Search
USPC ..... 131/270, 273, 194; 128/202.21
See application file for complete search history.

(56) References Cited

U.S. PATENT DOCUMENTS

| | | | | |
|---|---|---|---|---|
| 2,104,266 | A | 1/1938 | McCormick | |
| 5,205,278 | A | 4/1993 | Wang | |
| 5,240,012 | A * | 8/1993 | Ehrman et al. | 131/194 |
| 5,331,981 | A | 7/1994 | Tamaoki et al. | |
| 7,708,009 | B1 * | 5/2010 | Collins | 126/204 |
| 2005/0016549 | A1 | 1/2005 | Banerjee et al. | |
| 2005/0236006 | A1 * | 10/2005 | Cowan | 131/270 |
| 2006/0118128 | A1 * | 6/2006 | Hoffmann et al. | 131/271 |

FOREIGN PATENT DOCUMENTS

| | | | |
|---|---|---|---|
| CN | 1043077 | A | 6/1990 |
| CN | 1333657 | A | 1/2002 |
| DE | 19854009 | | 5/2000 |
| DE | 10064288 | | 8/2001 |
| EP | 0101256 | | 2/1984 |
| FR | 2818152 | A1 | 6/2002 |
| JP | S60-144380 | | 7/1985 |
| JP | H05-103836 | | 4/1993 |
| JP | H06-002164 | | 1/1994 |
| JP | 2002-529111 | | 9/2002 |
| JP | 2006-525798 | | 11/2006 |
| WO | 2004/098324 | | 11/2004 |

OTHER PUBLICATIONS

Second Office Action from counterpart Chinese patent application No. 200980133308.0, dated Oct. 10, 2012.

* cited by examiner

*Primary Examiner* — Richard Crispino
*Assistant Examiner* — Dionne W Mayes
(74) *Attorney, Agent, or Firm* — Dilworth & Barrese, LLP

(57) ABSTRACT

The present invention relates to a smoke-free cigarette with a thermal unit for the autarkical generation of heat and a nicotine reservoir in which nicotine or a nicotine-containing compound is contained, wherein the thermal unit comprises a crystallizable medium which releases heat during its crystallization.

23 Claims, 5 Drawing Sheets

SMOKE-FREE CIGARETTE

BACKGROUND OF THE INVENTION

The present invention relates to a smoke-free cigarette with a thermal unit for the autarkical generation of heat and a nicotine reservoir in which nicotine or a nicotine-containing compound is contained.

Smoke-free cigarettes are known from the prior art in a number of different embodiments.

From DE 10 2005 034 159 A1 a smoke-free cigarette is known, which includes a heat tube which is heated by means of the flame of a lighter. Due to its high thermal capacity, the heat tube releases heat over a sufficiently long period, so that the luxury product contained in a reservoir can evaporate.

From WO 2007/090594 A1 a smoke-free cigarette is known, which includes a nicotine depot and is characterized in that the air stream passed through the nicotine depot need not be heated to release the nicotine. The nicotine reservoir contains a carrier substance which at ambient temperature is already present in its gas phase.

WO 2007/054157 A1 relates to a smoke-free cigarette which includes a heating device configured with a current-carrying heating wire for heating a reservoir from which nicotine is released.

From DE 20 2006 001 663 U1 a smoke-free cigarette is known, which optically and geometrically is adapted to a commercially available cigarette, and which consists of two parts which are connected with each other by a suitable connection technique, preferably by plugging together.

DE 10 2006 047 146 A1 relates to a smoke-free cigarette with a heat accumulator for heating a nicotine-containing insert, wherein the heat accumulator is heated by a burner.

From DE 10 2006 004 484 A1 a smoke-free cigarette is known, which includes a heat accumulator for heating a nicotine-containing reservoir, which is heated by an incandescent filament.

DE 690 12 823 T2 relates to a smoke-free cigarette which contains nicotine-containing granules which the user can take up into the mouth through a sleeve.

From WO 2004/098324 A2 a smoke-free cigarette with a reusable and a non-reusable part is known, wherein the reusable part includes a heat source, whereas the non-reusable part comprises a nicotine reservoir and a mouthpiece.

SUMMARY OF THE INVENTION

It is the object underlying the present invention to provide a smoke-free cigarette which is comparatively simply constructed and leads to an effective heating of the air inhaled by a user and/or of the nicotine reservoir.

This object is solved by a smoke-free cigarette with the features herein.

The present invention comprises a smoke-free cigarette with a thermal unit for the autarkical generation of heat and a nicotine reservoir in which nicotine or a nicotine-containing compound is contained, wherein the thermal unit comprises a crystallizable medium which releases heat during its crystallization. In accordance with the invention it thus is provided that due to the crystallization of the medium heat is released, which serves to heat the nicotine reservoir and promote the release of nicotine and/or to heat the air inhaled by the user.

Advantageously, the thermal unit heats up to a temperature between 40° C. and 70° C., advantageously to a temperature between 45° C. and 55° C. This provides for a sufficient heating of the air inhaled by a user and/or of the nicotine reservoir, without the cigarette itself becoming too hot to be comfortably held and/or without requiring an expensive thermal insulation.

Advantageously, the thermal unit continuously emits heat for between 3 and 15 minutes, advantageously between 5 and 10 minutes. During this period, the thermal unit advantageously maintains a temperature between 40° C. and 70° C., furthermore advantageously between 45° C. and 55° C.

Furthermore, the crystallizable medium can be a supersaturated metastable solution. This supersaturated solution can crystallize out by releasing heat, when the crystallization process has been initiated.

Preferably, it is provided that the crystallizable medium, in particular the solution, is present in a metastable, supersaturated condition at least at ambient temperature, so that the crystallization can also be initiated at ambient temperature.

The crystallizable medium can contain stabilizers which act against an unintended crystallization. The medium can, however, also be free from stabilizers.

The crystallizable medium furthermore can contain crystallization nuclei. The same facilitate the initiation of the crystallization process. Advantageously, however, the medium is substantially free from crystallization nuclei. The crystallization process then can be initiated e.g. by introducing crystallization nuclei into the medium through a trigger mechanism.

Advantageously, it is provided in accordance with the invention that the crystallizable medium includes a liquid containing a salt hydrate. Advantageously, it is a supersaturated solution of the salt hydrate.

Alternatively, the crystallizable medium also can include sugar. However, such thermal units heat up more than those which are based on a salt hydrate, so that the cigarette can become too hot.

The salt hydrate can be sodium acetate trihydrate and/or Glauber's salt and/or magnesium nitrate hexahydrate. It is provided that the cigarette includes an autarkical thermal unit for generating heat and a nicotine reservoir in which nicotine or a nicotine-containing compound is contained. The thermal unit is configured such that it includes a liquid containing sodium acetate trihydrate and/or sodium sulfate and/or Glauber's salt and/or magnesium nitrate hexahydrate, which is present in the thermal unit in a metastable, supersaturated form and which releases heat upon crystallization of the sodium acetate trihydrate, the sodium sulfate, the Glauber's salt and/or the magnesium nitrate hexahydrate.

Advantageously, the smoke-free cigarette of the invention is configured in one part. This means that a user need not put together the cigarette of several parts, but that the same already is present ready for use as a complete smoke-free cigarette.

Furthermore, it can be provided that the smoke-free cigarette in its entirety is configured as a disposable article. The entire cigarette therefore is thrown away after a single use. In particular, the thermal unit is not reusable. This provides for an inexpensive construction and easy handling.

Advantageously, the smoke-free cigarette includes an outer envelope which surrounds the nicotine reservoir and the thermal unit.

The cigarette can include a mouthpiece, in particular in the form of a filter, wherein the outer envelope surrounds the nicotine reservoir, the thermal unit and the mouthpiece. The nicotine reservoir, the thermal unit and the mouthpiece are combined to one unit by the outer envelope. Advantageously, the outer envelope mechanically connects the mouthpiece with the nicotine reservoir and the thermal unit.

The outer envelope advantageously forms an air duct through which flows the air sucked in by a user. Advantageously, the air flows from one end of the cigarette through the nicotine reservoir to the other end of the cigarette.

Advantageously, the smoke-free cigarette comprises an outer envelope including several layers, of which the outer layer has the optical properties of a conventional cigarette, of which one further layer is a desorption barrier which is configured such that it prevents or at least substantially restricts the desorption of nicotine and/or flavoring agents, and of which one further layer is a stabilizing layer which is configured such that it provides the cigarette with the mechanical stability required for utilization.

The present invention thus relates to a smoke-free cigarette with a multilayer outer envelope whose layers perform different functions. To achieve the required shelf life, the multilayer outer envelope preferably is completely or largely desorption-tight, i.e. nicotine and/or flavoring agents remain in the space surrounded by the outer envelope, even if the smoke-free cigarette is stored for an extended period.

The outer envelope can include said three layers or also consist of the same.

Furthermore, the smoke-free cigarette can comprise an outer envelope including several layers, of which the outer layer is made of paper or includes paper, of which one further layer is made of metal or includes metal, and of which one further layer is made of a plastic material or includes a plastic material.

The paper layer can be the layer which has the optical properties of a conventional cigarette, the metal layer can be the layer which prevents or at least substantially impedes desorption, and the plastic layer can be the layer which provides the smoke-free cigarette with the required mechanical stability.

The outer paper layer serves the configuration of haptic, optical and tactile properties of a conventional cigarette. The metal layer, preferably aluminum layer, which directly or indirectly follows towards the interior, forms the desorption barrier for nicotine and flavoring agents. Preferably, it also serves for heat regulation during the active phase, i.e. during the phase of use of the smoke-free cigarette.

The further layer located inside relative to the metal layer can consist of a plastic layer. On the one hand, it provides the necessary total stability and preferably the puff regulation and the flavor stability.

The total arrangement, i.e. the multilayer outer envelope can be fabricated as a single layer or also as a composite material.

In a further aspect of the invention it is provided that the desorption barrier is arranged between the outer layer and the stabilizing layer, or that the layer made of metal or including metal is arranged between the outermost layer and the layer made of plastic material or including a plastic material. In this case, the desorption barrier forms a "middle layer" which is arranged between the outer layer and the inner layer.

The layers of the multilayer outer envelope can directly adjoin each other. In principle, however, it is also comprised by the invention that between the individual layers one or more further intermediate layers are arranged. Preferably, however, said layers of the outer envelope directly adjoin each other. Furthermore, it is preferably, but not necessarily, provided that the outer envelope only consists of these three layers.

As explained above, the metal preferably is aluminum. Thus, the desorption barrier preferably is formed by an aluminum layer or by a layer which at least includes aluminum.

The desorption barrier can be configured in the form of a foil, preferably in the form of a metal foil and particularly preferably in the form of an aluminum foil.

In a preferred aspect of the invention at least one layer, preferably several or all layers of the outer envelope are configured cylindrically in the form of a cigarette.

Furthermore, it can be provided that the layers of the outer envelope all extend over the same length or over different lengths of the cigarette. It is conceivable, for example, that the smoke-free cigarette has a mouthpiece and that the desorption barrier and/or the stabilizing layer extends up to the mouthpiece and the outer layer also extends around the mouthpiece. It is conceivable that the outer layer which surrounds the mouthpiece has the same color as a conventional cigarette in the region of the filter. Preferably, the mouthpiece is arranged such that the user takes up the nicotine and/or the flavoring agents through the mouthpiece with a draft of heated air. Thus, it is conceivable for example that a space adjoins the mouthpiece, in which the nicotine reservoir and/or a reservoir for flavoring agents and/or the autarkical thermal unit is arranged.

In a further aspect of the invention it is provided that the thickness of the layers of the outer envelope is identical.

It is, however, also comprised by the invention that one layer has a smaller thickness than the two other layers or that one layer has a greater thickness than the two other layers.

For example, it is conceivable that the desorption barrier, which can be configured as a foil, has a smaller thickness than at least one or also both of the two other layers.

Furthermore, it can be provided that the stabilizing layer has a greater thickness than at least one or also both of the other layers.

As explained, it preferably is provided that the outer envelope surrounds a space in which the thermal unit and/or the nicotine reservoir are arranged.

In a further aspect of the invention it is provided that the multilayer outer envelope has been fabricated in the form of a composite material or that the layers of the outer envelope are manufactured individually and then are possibly joined together by using connecting means.

In a further aspect of the invention it is provided that the cigarette furthermore includes a trigger mechanism to be actuated by a user, which initiates the crystallization. It can be provided that the crystallization is initiated by a mechanical operation.

The smoke-free cigarette in accordance with the present invention furthermore comprises a trigger mechanism by whose actuation the thermal unit is activated. Advantageously, it is provided that the trigger mechanism is configured such that it can be triggered by applying a compressive force.

The activation of the smoke-free cigarette thus is possible very easily in that the user exerts a compressive force, which leads to the fact that the thermal unit is activated, i.e. that the crystallization process is initiated and the thermal unit releases heat.

It is conceivable that the trigger mechanism is formed by a platelet protruding into the solution, preferably by a metal platelet. Due to the activation or movement of this platelet or the clip, the activation or initiation of the crystallization is effected. Due to the crystallization process heat is released continuously over a certain period, which—as explained—serves to heat the nicotine reservoir and/or to heat the air inhaled by the user.

Advantageously, however, it is provided that the trigger mechanism is configured such that it penetrates into the thermal unit upon activation.

Thus, it is conceivable for example to provide an injection pin or the like, which penetrates into the thermal unit upon actuation of the trigger mechanism. By the term "penetrate" it can be understood that the trigger mechanism or part thereof opens the wrapping of the thermal unit, i.e. breaks through the same, or that without such opening it only is pressed into the thermal unit. Such penetration can serve to start a crystallization in the thermal unit, whereby heat is released. This heat for example can serve to heat the stream of air inhaled by the user and/or to accelerate the release of nicotine from the reservoir.

Advantageously, penetration is effected by exerting a compressive force.

A particularly compact arrangement is obtained when the trigger mechanism is arranged in the interior of the cigarette and can be activated by pressing on one or more of the outer surfaces of the cigarette. It is conceivable that activation is effected by finger pressure on the outside of the cigarette.

In a further aspect of the invention it is provided that the trigger mechanism includes one or more injection elements, in particular injection pins or needles, which penetrate into the thermal unit upon actuation of the trigger mechanism. If a plurality of injection elements are present, it can be provided that the same are spaced from each other in peripheral direction of the cigarette. It is conceivable for example to arrange injection elements on two opposite sides of the thermal unit. It is also possible to provide three or four injection elements which each are spaced from each other in peripheral direction at an angle of 125° or at an angle of 90°. Of course, it is also conceivable to only provide one or more than four injection elements.

It is conceivable that the injection element(s) is (are) arranged on at least one spring. The spring can be a leaf spring, for example.

The spring can serve as a guide for the injection element(s).

The spring can be arranged on the thermal unit.

In a further aspect of the invention a fixing element is provided, by means of which the position of the injection element(s) can be determined. By means of the fixing element, the position of the injection elements thus can be adjusted.

The injection element(s) can be arranged on the fixing element or also on the above-mentioned spring.

The fixing element for example can be a fixing ring.

In a preferred aspect of the invention it is provided that the fixing element surrounds the injection element(s) and/or the at least one spring.

In a further aspect of the invention it is provided that the fixing element is deformable. It is conceivable that by exerting a compressive force on the deformable fixing element the user causes the injection element(s) to be pressed into the thermal unit.

In accordance with the invention it can be provided that due to the penetration of the injection element into the thermal unit the crystallization is initiated. It is conceivable that the injection element contains crystallization nuclei which are released upon penetration into the thermal unit.

In a further aspect of the invention it is provided that in peripheral direction the thermal unit is partly or completely surrounded by the nicotine-containing reservoir. The thermal unit hence is arranged in the interior of the smoke-free cigarette and is partly or completely surrounded by the nicotine reservoir.

Furthermore, it can be provided that the thermal unit comprises a rear side facing the user and a front side facing away from the user and that the rear side and/or the front side adjoins a tobacco element or is at least partly surrounded by the same.

In an alternative aspect of the invention it is provided that the thermal unit is present in a hollow cylindrical space in whose interior the nicotine reservoir is disposed. As a further alternative it can be provided that the thermal unit and the nicotine reservoir are arranged directly or indirectly one behind the other in longitudinal direction of the cigarette.

The nicotine reservoir can be present in the form of a substrate on whose surface the nicotine or the nicotine-containing compound is disposed, or also in the form of a substrate which contains the nicotine or the nicotine-containing compound. It is conceivable that the substrate is tobacco and in particular tobacco enriched with nicotine or a nicotine compound.

Preferably, the nicotine reservoir is arranged such that it can be heated by the thermal unit. Heating the nicotine reservoir can lead to the fact that the nicotine evaporates more easily or is desorbed by or otherwise separated from the substrate and thus correspondingly is introduced more easily into the stream of air generated by the user.

As explained above, one embodiment of the invention alternatively or additionally consists in that the stream of air generated by the user can be heated by the thermal unit. As compared to a cold stream of air to be inhaled by the user, this leads to a more pleasant feeling.

The cigarette can include a filter which substantially serves to limit the air flow through the cigarette. Alternatively or in addition it can be provided that the filter serves to retain substances which should not get into the air inhaled by the user.

The cigarette can include a sheath surrounding the thermal unit. Such aspect of the invention involves the advantage that the user does not directly contact the thermal unit but the sheath which preferably has a heat-insulating effect, so that its temperature lies below the temperature of the thermal unit.

The present invention furthermore relates to a smoke-free cigarette with an autarkical thermal unit for generating heat and with a nicotine reservoir in which nicotine or a nicotine-containing compound is contained, wherein the thermal unit is arranged such that it at least partly surrounds the nicotine reservoir. It thus is conceivable that the thermal unit is located closer to the outside of the cigarette than the nicotine reservoir. In the case of a cigarette configured preferably circular in cross-section it can thus be provided that the thermal unit is disposed in a region which in radial direction is located further to the outside than the nicotine reservoir.

On the other hand, it can be provided that the nicotine reservoir is located closer to the outside of the cigarette than the thermal unit. In the case of a cigarette configured preferably circular in cross-section it can thus be provided that the thermal unit is disposed in a region which in radial direction is located further to the inside than the nicotine reservoir. In particular, the nicotine reservoir can have a region in the form of a hollow cylinder, in whose interior the thermal unit is arranged.

The cigarette can include a closure element, in particular a cap or the like. Preferably, the closure element closes the end of the cigarette, which is spaced from the end disposed in the mouth during usage. It thus is conceivable that the one end of the cigarette is formed by the mouthpiece or by the portion of the cigarette disposed in the mouth and that the other end is closed by the cap. The closure can be air-tight.

The present invention furthermore comprises a method for manufacturing a smoke-free cigarette with the following steps:—providing a thermal unit,—providing a nicotine reservoir which advantageously surrounds the thermal unit,—providing a mouthpiece, and—arranging the mouthpiece, the nicotine reservoir and the thermal unit in a common outer envelope. In this way, a smoke-free cigarette ready for use is provided. Advantageously, a cigarette is manufactured as it has been described above.

The present invention furthermore comprises a method for providing a thermal unit for use in a smoke-free cigarette as described above, characterized in that the crystallizable medium is heated to a temperature at which it at least partly goes into solution and that the thermal unit is then filled with the solution.

Advantageously, the salt hydrate is heated to a temperature at which the salt at least partly goes into solution in its own crystal water.

The present invention hence comprises a method for filling a receptacle of an autarkical thermal unit for use in a smoke-free cigarette. It is provided that before and/or during filling into the receptacle of the autarkical thermal unit the medium is maintained or processed at a temperature of at least 50° C., preferably of at least 60° C.

It was found out that the spontaneous crystallization as well as doping with crystallization nuclei can effectively be prevented when the medium, in particular sodium acetate or a sodium acetate solution, is maintained and/or processed at a temperature of more than 50° C., preferably of more than 60° C. In accordance with the invention, a procedure is provided in this temperature range, whereby the crystallizable medium can reliably be filled into the receptacle of an autarkical thermal unit without spontaneous crystallization and without said doping with crystallization nuclei. This leads to a high reliability of the smoke-free cigarette configured with the autarkical thermal unit, since the crystallization and hence the production of heat does not occur prematurely, but but at the time desired by the user.

As explained, the medium can be sodium acetate or a solution containing sodium acetate. However, the invention is not limited to this medium, but can also comprise other crystallizable media and in particular salts, preferably salt hydrates such as hydrated sodium sulfate or magnesium nitrate hexahydrate.

In one aspect of the invention the medium is filled into a receptacle which has an inside diameter in the range from 2 mm to 7 mm, preferably in the range from 3 mm to 6 mm, and particularly preferably of not more than 6 mm.

The receptacle for example can have a length in the range from 70 mm to 110 mm, preferably in the range from 80 mm to 100 mm, and particularly preferably of not more than 100 mm.

These are exemplary values which do not limit the invention.

The receptacle can be configured for example in the form of a tube which can be round or also angular in cross-section. This tube is closed upon filling with the medium.

The activation, i.e. the initiation of the crystallization process, preferably is effected by the user of the smoke-free cigarette exerting pressure on the outside of the receptacle.

In a further aspect of the invention it is provided that the medium contains hydrate and/or water and that provisioning and/or filling is performed under a water vapor pressure which lies above the desorption pressure of the water of the medium. In this way, the dehydration of the salt hydrate solution or the medium during provisioning and/or during the filling process can be prevented. This dehydration would involve the disadvantage that it leads to an increase of the probability for crystallization. Therefore, provisioning and/or the filling process preferably is performed under a water vapor pressure higher than the water vapor pressure of the water in the salt hydrate solution or the medium.

It is conceivable to fill the medium from a storage container through a filling cannula into the receptacle of the autarkical thermal unit. It can be provided that the filling cannula also is heated and it is ensured that the same and/or the receptacle itself also is maintained at a comparatively high temperature in the ranges indicated above, in order to prevent the unintended crystallization of the medium and the unintended doping of the medium with crystallization nuclei.

It is conceivable that before filling the medium is received in a storage container and directly or indirectly, for example by means of said cannula or other supply means, delivered from the storage container into the receptacle of the autarkical thermal unit by means of a filling mechanism, preferably by means of a hydraulically operating filling mechanism.

The present invention furthermore relates to a smoke-free cigarette with one or more autarkical thermal units which are filled by the method described.

The present invention furthermore comprises a method for filling a smoke-free cigarette with a thermal unit in accordance with the invention. It is provided that the sodium acetate trihydrate and/or the sodium sulfate and/or the Glauber's salt and/or the magnesium nitrate hexahydrate are heated to a temperature at which the salt at least partly goes into solution and that the solution then is filled into the space of the cigarette provided for accommodating the thermal unit.

Preferably, it can be provided that the sodium acetate trihydrate and/or the sodium sulfate and/or the Glauber's salt and/or the magnesium nitrate hexahydrate are heated to a temperature at which the salt at least partly goes into solution in its own crystal water.

BRIEF DESCRIPTION OF THE DRAWINGS

Further details and advantages of the invention will be explained in detail with reference to an embodiment illustrated in the drawing.

DESCRIPTION OF THE PREFERRED EMBODIMENTS

Figure 1:
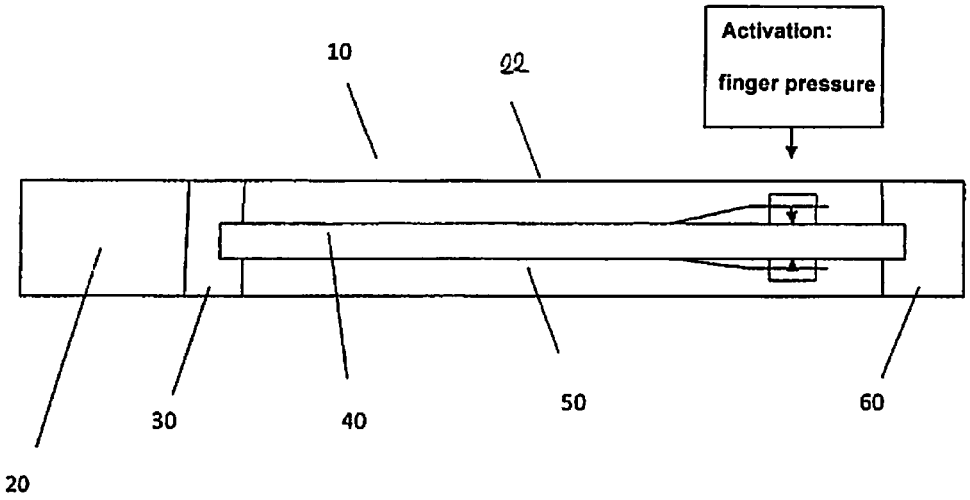
FIG. 1: shows a smoke-free cigarette in accordance with the present invention in a longitudinal section in a first embodiment.

The smoke-free cigarette in accordance with the present invention should supply nicotine, but rather not noxious and carcinogenic substances to the smoker. The smoke-free cigarette 10 comprises an autarkical thermal unit 14 or 40, a nicotine-containing substrate 15 or 50 and a mouthpiece 20.

The smoke-free cigarette 10 in accordance with the present invention functions without supply of heat or energy from outside and thus is autarkical. The smoke-free cigarette of the present invention is configured such that it is immediately ready for operation, if this is desired by the user. In particular, it is a disposable cigarette, which can be used only once and is then thrown away.

In the interior of the thermal unit a liquid to be crystallized is contained, which is able to release heat during the crystallization. The crystallization process is started by actuation of a trigger mechanism, wherein the entire unit is heated to about 45 to 55° C. and continuously releases heat for about 5 to 10 minutes. These values are exemplary values. The temperature and the time period during which heat is released can for example be adjusted via the amount of salt to be crystallized.

Advantageously, the thermal unit is dimensioned such that the same releases heat for at least one minute, preferably for a period in the range from 2 to 4 minutes.

When the user pulls air through the mouthpiece 20, the stream of air is guided through the tobacco 15, 50 and thereby heated over the effective length due to the heat generated by the thermal unit 14, 40. The air stream absorbs the evaporating nicotine along with flavoring agents and is passed through the mouthpiece 20, which can also serve as filter. The mouthpiece 20 limits the air stream and is dimensioned such that maximum nicotine limit values are not reached or exceeded.

The smoke-free cigarette 10 in accordance with the present invention functions without supply of heat or energy from outside and thus is autarkical. After activation of the thermal unit the crystallization of the supersaturated, metastable solution begins. For example, it can be a solution of sodium acetate trihydrate ($CH_3COONa3H_2O$) in liquid. The crystallization heat released during the exothermal reaction is released in several steps.

After activation, the sodium acetate trihydrate spontaneously crystallizes out and releases the heat stored in the unit in the form of latent heat ($CH_3COO^-$(aq.)+ $Na^+$(aq.)→$CH_3COONa3H_2O$ (solid) plus heat), wherein the ions present in the unit initially form the ionic lattice.

Simultaneously with this process, the water molecules take the places defined in the interstices of the ionic lattice formed in this way, with their dipoles being aligned exactly. In this way, the water molecules form a lattice in the crystal lattice.

In the case of the sodium acetate trihydrate three water molecules are arranged per formula unit.

The heat released during crystallization thus on the one hand consists of the latent heat of the salt, i.e. of its heat of solution or heat of crystallization. On the other hand, heat is produced during the strongly exothermal formation of the lattice of water molecules, which takes place in parallel thereto. This heat of formation of the hydrate likewise is a latent heat.

Alternatively or in addition to the use of sodium acetate trihydrate, sodium sulfate or the so-called Glauber's salt, i.e. the decahydrate ($Na_2SO_4$ 10 $H_2O$) can be used. Alternatively or in addition, the use of magnesium nitrate hexahydrate ($Mg(NO_3)_2$6 $H_2O$) as such or in a mixture with lithium nitrate ($LiNO_3$) can also be considered.

The mouthpiece 20 ensures a constant draft of air inside the cigarette.

FIG. 1 shows a first embodiment of the present invention. The cigarette 10 includes an outer envelope 22, which can have a design as it corresponds to a conventional cigarette. The outer envelope 22 and hence the outer shape of the cigarette 10 preferably is cylindrical. The outer envelope can be constructed as it will yet be shown in detail with reference to FIG. 6.

At its end facing the user, the cigarette 10 includes a filter 20, by means of which the air volume to be inhaled per unit time can be limited or be maintained at a constant value.

Adjacent to the filter 20 a tobacco piece 30 is provided, in which the end region of a thermal unit 40 facing the user is arranged. The thermal unit 40 is located in the interior of the cigarette 10 and in peripheral direction is completely surrounded by tobacco 50 which is enriched with nicotine. This tobacco filling 50 is disposed in the annular space which surrounds the thermal unit 40.

Adjacent to this tobacco substrate 50 enriched with nicotine a further tobacco piece 60 is provided, which forms the end of the cigarette 10 facing away from the user.

The smoke-free cigarette 10 furthermore comprises a sheath surrounding the thermal unit 40 on its outside, which consists e.g. of a plastic film.

The trigger mechanism of the first embodiment, which is shown again in detail in FIG. 2, will now be described. In the region of the thermal unit 40 facing away from the user one or more resilient guides 70 are fixed to the same.

The spring 70 has an inclined portion which extends at an acute angle with respect to the longitudinal axis of the thermal unit 40, and an adjoining portion which extends parallel to the longitudinal axis of the thermal unit 40 or of the cigarette 10.

In one region, the springs 70 are surrounded by a fixing ring 80 which is deformable.

On the fixing ring 80 or on the spring(s) 70, one or more injection pins 90 are arranged, which extend vertical to the thermal unit 40.

If the injection pin(s) 90 is (are) arranged on the spring 70, this preferably is the case in the region in which the spring 70 extends parallel to the longitudinal axis of the thermal unit 40.

While the spring 70 exerts a force directed away from the thermal unit 40, it can be provided that the fixing ring 80 has the function to position the springs 70 and hence the injection pins 90 such that in the non-actuated condition they sit on the surface of the thermal unit 40 or only have a small distance from the same, but only penetrate into the same when a compressive force acts on the fixing ring 80 or on the injection pins 90 from outside.

Figure 2:
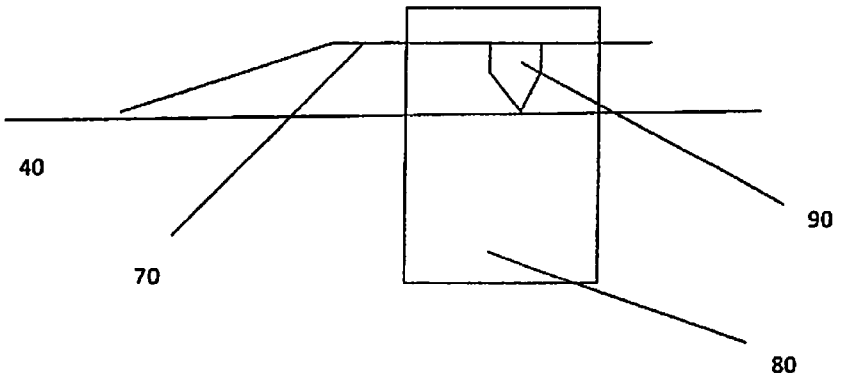
FIG. 2: shows an enlarged segment of the trigger mechanism shown in FIG. 1, FIG. 3: shows a smoke-free cigarette in accordance with the present invention in a longitudinal section in a second embodiment.

As can be taken from FIG. 2, the injection pins 90 have a pointed end with which they penetrate into the thermal unit 40 upon actuation of the trigger mechanism.

Due to the penetration of the injection pin(s) 90, a change of stage, in particular a crystallization, can be initiated, in which heat is released. It is conceivable that the change of state is caused by the penetration of the injection pin 90 into the thermal unit 40 or that the injection pin 90 for example includes means which promote the change of stage, such as crystallization nuclei.

The configuration of the cigarette in accordance with the invention includes a comparatively simply constructed and easily actuated trigger mechanism. In addition, the same can be fabricated such that it is small sized, so that miniaturization is possible.

Figure 3:
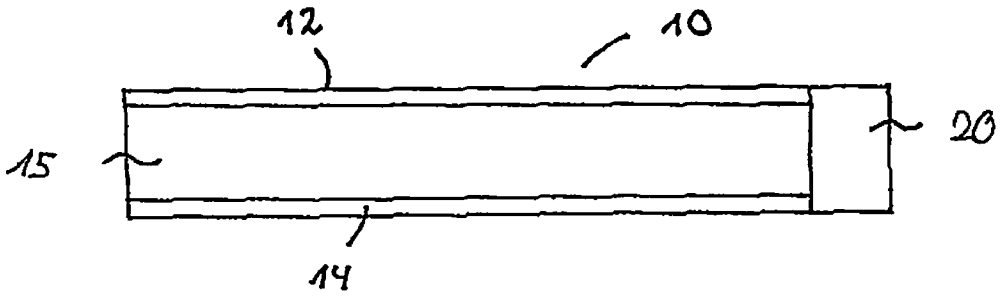

FIG. 3 now shows a second embodiment which differs from the first embodiment in the arrangement of nicotine reservoir and thermal unit and in the trigger mechanism. The medium used in the thermal unit is configured exactly as described above.

In the second embodiment, conventional tobacco which is slightly enriched with nicotine is disposed in a cylindrical inner space 15, which is surrounded by the hollow cylindrically arranged or configured thermal unit 14. The mouthpiece 20 provides a constant draft of air within the system. Via a trigger mechanism not shown in detail in FIG. 3, the crystallization is started and thereby the process of releasing heat is initiated. The initiation of the crystallization process is effected e.g. by a metal clip protruding into the solution, which is actuated mechanically and by which the crystallization is started and accelerated.

The smoke-free cigarette 10 furthermore comprises a sheath 12 surrounding the thermal unit 14 on its outside. The same consists of a doubly sheathed plastic film, in whose interior the crystalline liquid or the liquid to be crystallized is contained, which is able to store heat. In accordance with the embodiment shown in the drawing, the sheath 12 only surrounds the thermal unit, but not the mouthpiece as well. In principle, however, it is also conceivable to provide the sheath 12 also over the entire length of the smoke-free cigarette and hence also over the mouthpiece 20.

The sheath 12 of the cigarette on the one hand serves to prevent the direct contact with the heat source in the form of the thermal unit 14 and/or is designed such that it optically resembles a conventional cigarette. The sheath 12 can be configured such as it will yet be shown below with reference to FIG. 6.

Figure 4:
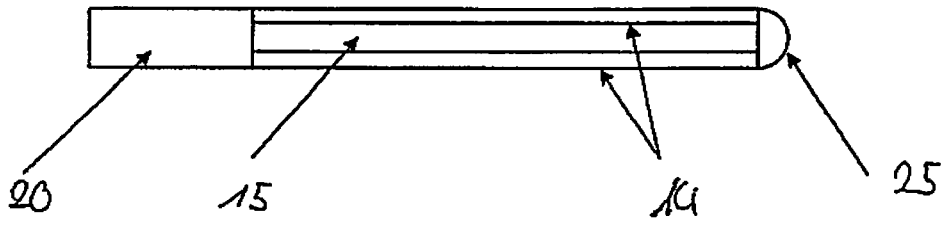
FIG. 4: shows a smoke-free cigarette in accordance with the present invention in a longitudinal section in a third embodiment.

In contrast to the embodiment as shown in FIG. 3, it is provided in accordance with FIG. 4 that the end of the cigarette 10 spaced from the mouthpiece 20 is closed by a capping 25. Prior to use, the user separates or tears off the cap 25 from the cigarette 10, which results in the fact that air can be sucked through the cigarette 10 or through the nicotine-containing substrate 15.

Apart from the embodiments shown in FIGS. 1 to 4 it is also conceivable to change the arrangement of the thermal unit and of the nicotine-containing substrate. It is conceivable, for example, to arrange the thermal unit and the nicotine-containing substrate one behind the other in longitudinal direction of the cigarette. It is conceivable, for example, to arrange the thermal unit at the end of the cigarette spaced from the mouthpiece 20 and the nicotine-containing substrate between thermal unit and mouthpiece.

Figure 5:
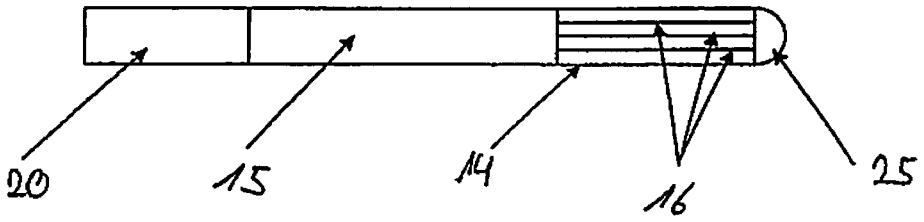
FIG. 5: shows a smoke-free cigarette in accordance with the present invention in a longitudinal section in a fourth embodiment.

Such configuration of the cigarette can be taken from FIG. 5. Between thermal unit 14 and mouthpiece 20 the nicotine-containing substrate 15 is disposed. In the embodiment of FIG. 5, the thermal unit 14 also is closed by the cap 25 which prevents the access of air to the substrate 15, until it is removed by the user.

FIG. 5 furthermore shows that the thermal unit 14 is interspersed with air ducts 16. The same extend in longitudinal direction of the cigarette 10. The feature that one or more air ducts 16 are arranged in the thermal unit 14, in order to improve or just provide for the air supply, is not limited to the embodiment as shown in FIG. 5, but is an aspect of the present invention which is possible in principle.

It is conceivable to make the sheath of the cigarette airtight. It is also conceivable, however, to make the sheath air-permeable, which results in that oxygen also (or exclusively) penetrates into the thermal unit 14 or into the substrate 15 via the sheath surface. To prevent that this happens before it is desired by the user, it can be provided to enclose the sheath with a preferably air-tight envelope which can be removed by the user.

Figure 6:
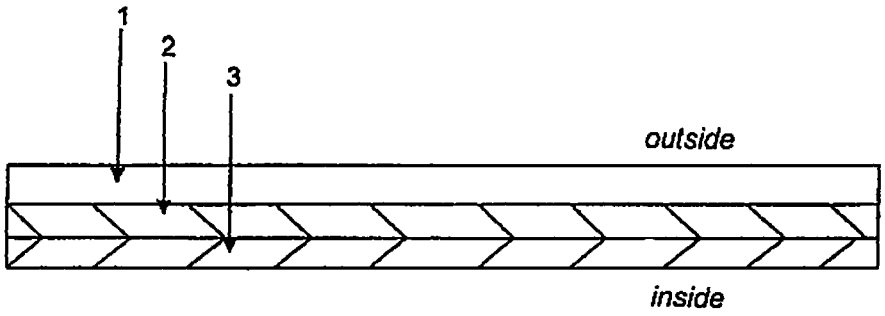
FIG. 6: shows a sectional view through a three-layer outer envelope of a smoke-free cigarette in accordance with the invention.

FIG. 6 shows a longitudinal section through an embodiment of a three-layer outer envelope of a smoke-free cigarette. In particular, such outer envelope can be used in one of the aforementioned embodiments.

As shown, the outer envelope consists of three material layers. The outer paper layer 1 serves the configuration of haptic, optical and tactile properties of a conventional cigarette.

This paper layer 1 inwardly is adjoined by an aluminum layer 2, which forms the desorption barrier for nicotine and flavoring agents/flavors present in the space surrounded by the outer envelope.

During the phase of use of the smoke-free cigarette, i.e. during the generation of heat by the autarkical thermal unit, the aluminum layer also serves for heat regulation.

The aluminum layer 2 inwardly is adjoined by a plastic layer 3. The same consists of a plastic sheet and on the one hand provides the necessary total stability of the smoke-free cigarette, puff regulation and flavor stability.

As can be taken from FIG. 6, three layers can thus be provided, in order to form the entire outer envelope.

It is, however, also comprised by the invention that between two or all of the layers shown intermediate layers are provided, which have certain functional properties, such as improvement of the adhesion of the layers to each other, etc.

Preferably, however, the outer envelope only consists of the three layers shown. An essential advantage of the illustrated arrangement consists in that a smokeless cigarette is provided, which can be stored over an extended period, since the desorption of nicotine or flavoring agents is largely impeded or completely prevented, without having to omit the familiar haptics of conventional cigarettes.

The paper layer can form the outermost layer of the multilayer outer envelope. In principle, however, it is also comprised by the invention that a further layer, such as a coating or the like, is applied onto this layer. Similarly, the inner layer, i.e. the plastic layer 3 can form the innermost layer of the multilayer outer envelope. However, it is also comprised by the invention that a further layer, such as an inner coating, adjoins the inner layer.

In the drawing, the three layers 1, 2, 3 of the outer envelope are shown with an identical or largely identical thickness. However, the invention also comprises the case that different thicknesses can be provided. For example, it can be sufficient to provide the desorption barrier in the form of a comparatively thin aluminum foil, which can represent the thinnest layer of the three illustrated layers.

The outer envelope shown in FIG. 6 in a longitudinal section has the shape of a hollow cylindrical body in whose interior a matrix is disposed, on which nicotine and flavoring agents are provided. In the interior, the autarkical thermal unit furthermore is provided in the form of a crystallizable medium. This autarkical thermal unit can be activated for example by the user applying pressure from outside on the illustrated outer envelope. This results in crystallization and hence in the release of heat. On the one hand, a draft of air which is drawn through the interior of the smoke-free cigarette and possibly a mouthpiece is heated by this release of heat. Heating furthermore leads to the fact that the desorption of nicotine and/or flavoring agents from said matrix is facilitated.

The manufacture of a thermal unit will now be described in detail. For filling the thermal unit with a supersaturated metastable solution the salt initially is heated. First of all, the crystal water lattice collapses. At the same time, the ionic lattice also is destroyed. This process takes place when heating the salt to a temperature of about 58° C.

This process is a process of dissolution.

In the case of the sodium acetate trihydrate this process takes place at a temperature of about 58° C. Initially, anhydrous sodium acetate is obtained. If heating is continued, the sodium acetate obtained is at least partly dissolved in its own crystal water. Corresponding processes take place when using Glauber's salt, i.e. the sodium sulfate decahydrate, and also when using magnesium nitrate hexahydrate, which can be present in a combination with lithium nitrate.

Figure 7:
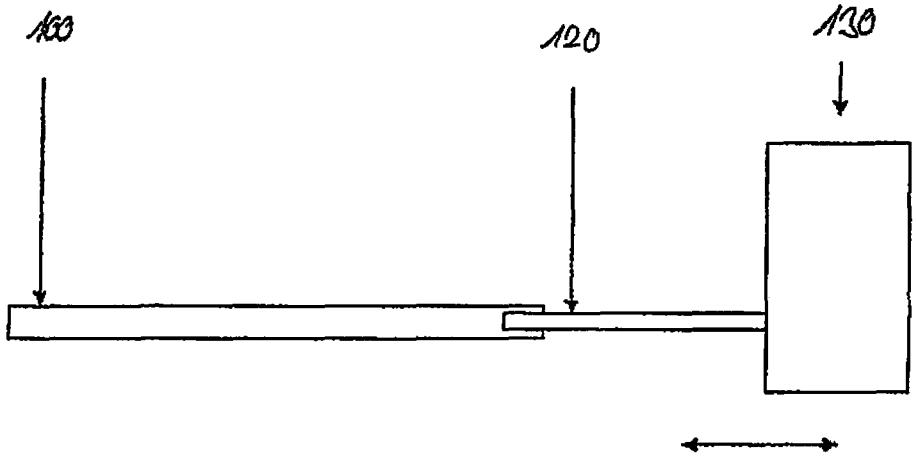
FIG. 7: shows a schematic drawing of a filling operation of a thermal unit.

A method for manufacturing a thermal unit will now be described in detail with reference to FIG. 7. In a schematic view, FIG. 7 shows the thermal pad tube 100, which upon filling with a crystallizable medium is closed and then used as an autarkical thermal unit of a smoke-free cigarette.

As shown in the Figure, the thermal pad tube, which can have a maximum diameter of 6 mm and a maximum total length of 100 mm, is filled by means of a filling cannula 120 which in turn is connected with a storage container 130. The storage container 130 is connected with a non-illustrated filling hydraulic which has the function to fill the crystallizable medium through the filling cannula 120 into the interior of the thermal pad tube 100.

As is illustrated by the double arrow in the Figure, the storage container 130 or the filling cannula 120 can be moved relative to the thermal pad tube 100 in axial direction thereof, so that for example first the left portion of the tube 100 as shown in the Figure and subsequently the regions adjoining thereto in the direction of the opening of the thermal pad tube 100 are filled.

In the embodiment shown here in detail, sodium acetate in the liquid condition ready for use should be processed and filled in.

Into the prefabricated, unilaterally closed thermal pad tubes 100, the sodium acetate is introduced by means of one or more cannulas 120, and subsequently the tubes 100 are closed. As explained above, to prevent the unintended spontaneous crystallization and the unintended doping with crystallization nuclei, the sodium acetate is maintained and processed at a temperature of more than 60° C. in the storage container 130 and possibly in addition also in the filling cannula 120. This procedure prevents both the spontaneous crystallization and the doping with crystallization nuclei.

To prevent a change in the water content of the sodium acetate solution, the water vapor pressure of the salt hydrate solution in the storage container 130 or in the filling cannula 120 is adjusted to a value higher than the desorption pressure of the water in the salt hydrate solution.

In principle, it is possible to adjust the temperature conditions described above and the water vapor pressure in the storage container 130 and/or in the filling cannula 120 and/or in the thermal pad tube 100 itself. In this way, it is reliably prevented that an undesired, premature crystallization occurs.

The sodium acetate thermal pad in accordance with the embodiment described here is immediately ready for use upon filling. Due to the filling operation described above, the further processing of the thermal pad or of the thermal pad tubes 100 is unproblematic, and they or the smoke-free cigarettes provided therewith for example can also be stored over an extended period without the occurrence of an unintended crystallization of the sodium acetate.

The present invention not only relates to cigarettes in the actual sense, but also to cigars. Thus, the term "cigarette" stands both for cigarettes and for cigars.

The invention claimed is:

1. A smoke-free cigarette with a thermal unit for the autaskieal generation of heat and a nicotine reservoir in which nicotine or a nicotine-containing compound is contained, wherein the thermal unit comprises a crystallizable medium which releases heat during its crystallization, and the smoke-free cigarette comprises an outer envelope including an outer layer, a desorption barrier and a stabilizing layer, wherein the outer layer has the optical properties of a conventional cigarette, the desorption barrier is configured such that it prevents or restricts the desorption of nicotine and/or flavoring agents, the stabilizing layer is configured such that it provides the cigarette with a mechanical stability sufficient for its utilization, the desorption barrier is arranged letween the outer layer and the stabilizing layer, the outer layer is made of paper or includes paper, the desorption barrier is made of metal or includes metal, and the stabilizing layer is made of a plastic material or includes a plastic material.

2. The smoke-free cigarette according to claim 1, wherein the thermal unit heats up to a temperature between 40° C. and 70° C., advantageously to a temperature between 45° C. and 55° C.

3. The smoke-free cigarette according to claim 1, wherein the thermal unit continuously emits heat for a period between 3 and 15 minutes, advantageously between 5 and 10 minutes.

4. The smoke-free cigarette according to claim 1, wherein the crystallizable medium is a supersaturated metastable solution.

5. The smoke-free cigarette according to claim 1, wherein the crystallizable medium includes a liquid containing salt hydrate or consists of the same.

6. The smoke-free cigarette according to claim 5, wherein the salt hydrate is sodium acetate trihydrate and/or Glauber's salt and/or magnesium nitrate hexahydrate.

7. The smoke-free cigarette according to claim 1, Wherein the smoke-free cigarette is configured in one part,

8. The smoke-free cigarette according to claim 7, wherein the cigarette includes a mouthpiece, in particular in the form of a filter, and the outer envelope surrounds the nicotine reservoir, the thermal unit and the mouthpiece, wherein the outer envelope advantageously mechanically connects the mouthpiece with the nicotine reservoir and the thermal unit.

9. The smoke-free cigarette according to claim 1, wherein the smoke-free cigarette in its entirety is configured as a disposable article.

10. The smoke-free cigarette according to claim 1, wherein the smoke-free cigarette includes an outer envelope which surrounds the nicotine reservoir and the thermal unit.

11. The smoke-free cigarette according to claim 1, wherein the cigarette furthermore includes a trigger mechanism to be actuated by a user, which initiates the crystallization.

12. The smoke-free cigarette according to claim 11, with the thermal unit for the autarkical generation of heat and with the nicotine reservoir in which nicotine or the nicotine-containing compound is contained, wherein the trigger mechanism is provided, by which the thermal unit is activated upon actuation of the trigger mechanism, and the trigger mechanism is configured such that the trigger mechanism or part thereof can he activated upon application of a compressive force.

13. The smoke-free cigarette according to claim 11, comprising the thermal unit for the autarkical generation of heat and the nicotine reservoir in which nicotine or the nicotine-containing compound is contained, wherein the trigger mechanism is provided, by which the thermal unit is activated upon actuation of the trigger mechanism, and the trigger mechanism is configured such that the trigger mechanism or part thereof penetrates into the thermal unit upon activation.

14. The smoke-free cigarette according to claim 11, wherein the trigger mechanism is arranged in the interior of the cigarette such that it can be activated by applying pressure on one or more of the outer surfaces of the cigarette.

15. The smoke-free cigarette according to claim 11, wherein the trigger mechanism includes one or more injection elements, in particular injection pins or needles, which penetrate into the thermal unit upon actuation of the trigger mechanism.

16. The smoke-free cigarette according to claim 1, wherein in peripheral direction the thermal unit is partly or completely surrounded by the nicotine-containing reservoir and/or that the thermal unit comprises a rear side facing the user and a front side facing away from the user and that the rear side and/or the front side adjoins a tobacco element or is at least partly surrounded by the same.

17. The smoke-free cigarette according to claim 1, wherein the nicotine reservoir is arranged such that it can be heated by the thermal unit.

18. The smoke-free cigarette according to claim 1, wherein the thermal unit is present in a hollow cylindrically configured space in whose interior the nicotine reservoir is disposed or the thermal unit and the nicotine reservoir are directly or indirectly arranged one behind the other in longitudinal direction of the cigarette.

19. The smoke-free cigarette according to claim 1, wherein the thermal unit is arranged such that a stream of air generated by a user can be heated by the thermal unit.

20. The smoke-free cigarette according to claim 1, wherein the cigarette includes a filter which effects a limitation of the air volume flow generated by a user.

21. The smoke-free cigarette according to claim 1, wherein the cigarette includes a sheath surrounding the thermal unit.

22. The smoke-free cigarette according to claim 1, wherein the cigarette includes a closure element, in particular a cap.

23. The smoke-free cigarette of claim 1, wherein the desorption barrier is made of aluminum.

* * * * *